US010718289B2

(12) United States Patent
Surnilla et al.

(10) Patent No.: US 10,718,289 B2
(45) Date of Patent: Jul. 21, 2020

(54) METHODS AND SYSTEMS FOR FIXED AND VARIABLE PRESSURE FUEL INJECTION

(71) Applicant: Ford Global Technologies, LLC, Dearborn, MI (US)

(72) Inventors: Gopichandra Surnilla, West Bloomfield, MI (US); Joseph F. Basmaji, Waterford, MI (US); Mark Meinhart, Dexter, MI (US); Ross Dykstra Pursifull, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 199 days.

(21) Appl. No.: 15/643,675

(22) Filed: Jul. 7, 2017

(65) Prior Publication Data

US 2017/0306881 A1 Oct. 26, 2017

Related U.S. Application Data

(62) Division of application No. 14/570,546, filed on Dec. 15, 2014, now Pat. No. 9,752,530.

(51) Int. Cl.
*F02M 7/00* (2006.01)
*F02D 41/38* (2006.01)
(Continued)

(52) U.S. Cl.
CPC ..... *F02D 41/3845* (2013.01); *F02D 35/027* (2013.01); *F02D 2041/389* (2013.01); *F02D 2041/3881* (2013.01); *F02M 63/029* (2013.01)

(58) Field of Classification Search
CPC ..... F02D 41/3094; F02D 2200/0602; F02D 41/3845; F02D 41/3854
(Continued)

(56) References Cited

U.S. PATENT DOCUMENTS 5,575,625 A 11/1996 Castel
7,353,798 B2 4/2008 Tokuda et al.
(Continued)

FOREIGN PATENT DOCUMENTS

CN 101087938 A 12/2007
CN 102251866 A 11/2011
(Continued)

OTHER PUBLICATIONS

National Intellectual Property Administration of the People's Republic of China, Office Action and Search Report Issued in Application No. 201510930554.6, Dec. 5, 2019, 13 pages. (Submitted with Partial Translation).

*Primary Examiner* — Long T Tran
*Assistant Examiner* — James J Kim
(74) *Attorney, Agent, or Firm* — Geoffrey Brumbaugh; McCoy Russell LLP

(57) ABSTRACT

Methods and systems are provided for operating a high pressure injection pump to provide each of high fixed fuel pressure at a port injection fuel rail and high variable fuel pressure at a direct injection fuel rail. Port injection fuel rail pressure can be raised above a pressure provided with a lift pump via a fuel system configuration that includes various check valves, pressure relief valves, and a spill valve positioned between an inlet of the high pressure injection pump and the port injection fuel rail. High pressure port injection may be advantageously used to provide fuel at high pressure during conditions when fuel delivery via high pressure direct injection is limited.

10 Claims, 6 Drawing Sheets

(51) Int. Cl.
*F02D 35/02* (2006.01)
*F02M 63/02* (2006.01)

(58) Field of Classification Search
USPC ..... 123/435, 431, 294, 456
See application file for complete search history.

(56) References Cited

U.S. PATENT DOCUMENTS 7,389,766 B2 6/2008 Akita et al.
8,245,693 B2 8/2012 Sumilla et al.
8,776,764 B2 7/2014 Basmaji et al.
9,316,161 B2 4/2016 Sumilla et al.
9,416,747 B2 8/2016 Mashiki
9,599,082 B2 3/2017 VanDerWege et al.
9,611,801 B2 4/2017 Sumilla et al.
9,657,680 B2 5/2017 Sumilla et al.
9,726,106 B2 8/2017 Sumilla et al.
2003/0127070 A1 7/2003 Xu
2005/0199218 A1* 9/2005 Hashima ..... F02D 41/3029 123/431
2006/0000452 A1 1/2006 Tokuda et al.
2006/0075992 A1* 4/2006 Akita ..... F02D 41/3094 123/431
2007/0199542 A1* 8/2007 Tokuda ..... F02D 33/006 123/431
2008/0072880 A1 3/2008 Wachtendorf et al.
2008/0116300 A1 5/2008 Ricco et al.
2009/0320796 A1* 12/2009 Kojima ..... F02M 55/04 123/447
2011/0097228 A1* 4/2011 Tokuo ..... F02M 37/0047 417/505
2011/0278369 A1 11/2011 Serra et al.
2012/0240669 A1* 9/2012 Nishigaki ..... F02D 41/221 73/114.45
2013/0151052 A1 6/2013 Fukuzawa
2013/0192202 A1* 8/2013 Lambert ..... F02D 41/029 60/274
2013/0247874 A1 9/2013 Saito
2014/0230793 A1* 8/2014 Mashiki ..... F02D 41/3094 123/478
2014/0251280 A1* 9/2014 Ikoma ..... F02D 41/042 123/478

FOREIGN PATENT DOCUMENTS

CN 103249936 A 8/2013
CN 103842636 A 6/2014

* cited by examiner

METHODS AND SYSTEMS FOR FIXED AND VARIABLE PRESSURE FUEL INJECTION

CROSS REFERENCE TO RELATED APPLICATION

The present application is a divisional of U.S. patent application Ser. No. 14/570,546, entitled "METHODS AND SYSTEMS FOR FIXED AND VARIABLE PRESSURE FUEL INJECTION," filed on Dec. 15, 2014. The entire contents of the above-referenced application are hereby incorporated by reference in its entirety for all purposes.

FIELD

The present description relates to systems and methods for adjusting operation of fuel injectors for an internal combustion engine. The methods may be particularly useful for an engine that includes high pressure port and/or direct fuel injectors.

BACKGROUND AND SUMMARY

Direct fuel injection (DI) systems provide some advantages over port fuel injection systems. For example, direct fuel injection systems may improve cylinder charge cooling so that engine cylinders may operate at higher compression ratios without incurring undesirable engine knock. However, direct fuel injectors may not be able to provide a desired amount of fuel to a cylinder at higher engine speeds and loads because the amount of time a cylinder stroke takes is shortened so that there may not be sufficient time to inject a desired amount of fuel. Consequently, the engine may develop less power than is desired at higher engine speeds and loads. In addition, direct injection systems may be more prone to particulate matter emissions.

In an effort to reduce the particulate matter emissions and fuel dilution in oil, very high pressure direct injection systems have been developed. For example, while nominal direct injection maximum pressures are in the range of 150 bar, the higher pressure DI systems may operate in the range of 250-800 bar.

One issue with such high pressure DI systems is that when the engine is configured with both direct fuel injection and port fuel injection (DI-PFI systems), the system is limited to operating the port fuel injection system at low pressure conditions. In other words, high pressure port fuel injection, such as higher than 5 bar, may not be possible without the inclusion of an additional dedicated pump. As such, while there may be conditions when high pressure port fuel injection is desirable, the addition of another pump for raising the pressure of the port injection system may add cost and complexity. Another issue with such high pressure DI systems is that the dynamic range of the injectors may be limited by the rail pressure. Specifically, when the rail pressure is very high and the engine has to operate at low loads, the direct injector pulse width may be very small. Under such small pulse width conditions, direct injector operation may be highly variable. In addition, at very low pulse widths, the direct injector may not even open. These conditions can result in large fueling errors.

In one example, the above issue may be at least partly addressed by a method for an engine, comprising: operating a high pressure fuel pump to deliver fuel at a variable pressure to a first fuel rail coupled to direct fuel injectors, and at a fixed pressure to a second fuel rail coupled to port fuel injectors, the fuel delivery controlled via a mechanical spill valve of the pump, wherein the second rail is coupled to an inlet while the first rail is coupled to an outlet of the pump. In this way, the specific configuration of the fuel rails relative to the high pressure fuel pump, as well the use of a mechanical spill valve and various additional check valves, enables a single high pressure fuel pump to be used to provide a substantially higher port fuel injection pressure.

As an example, a fuel system may be configured with a low pressure lift pump and a high pressure injection pump. The high pressure pump may be a piston pump. An output of the high pressure injection pump may be controlled mechanically, and not electronically, via the use of a magnetic solenoid valve (MSV). At least one check valve and one pressure relief valve (or over-pressure valve) may be coupled between the lift pump and the injection pump. A first fuel rail delivering fuel to direct fuel injectors may be coupled to an outlet of the injection pump via a check valve and a pressure relieve valve. Likewise, a second fuel rail delivering fuel to port fuel injectors may be coupled to an inlet of the injection pump, also via a check valve and a pressure relieve valve. An unenergized MSV enables a fixed pressure of the second fuel rail to be raised substantially higher than the fuel pressure provided by the lift pump. For example, the pressure of the second fuel rail delivering fuel to port injectors can be raised to the same level as the minimum pressure of the first fuel rail delivering fuel to direct injectors (such as at 15 bar). The pressure of the first fuel rail may be further raised and varied by adjusting the pump output via the MSV. Thus, based on engine operating conditions, fuel may be delivered at high pressure to an engine cylinder via port injection and/or via direct injection. Further, during conditions when fuel delivery via high pressure direct injection is limited, such as during cold-starts (and extreme cold-starts) or when engine exhaust emissions are particulate matter limited, direct injection may be disabled and fuel may be delivered via one or more high pressure port injections.

In this way, port fuel injection may be provided at fuel pressures that are higher than the default pressure provided by a lift pump. More specifically, a high pressure displacement pump can be advantageously used for providing variable high pressure to a direct injection fuel rail while also providing a fixed high pressure to a port injection fuel rail. By raising the port injection default pressure to be as high as the direct injection minimum pressure, various benefits of high pressure port injection can be achieved. For example, fuel can be port injected at high pressure without incurring particulate matter issues associated with direct injection. In addition, smaller amounts/volumes of fuel can be port injected more accurately when direct injection of the equivalent amount is limited by the pulse-width or dynamic range of the direct fuel injector. Overall, fuel injection efficiency is increased and fueling errors are reduced, improving engine performance.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 4:
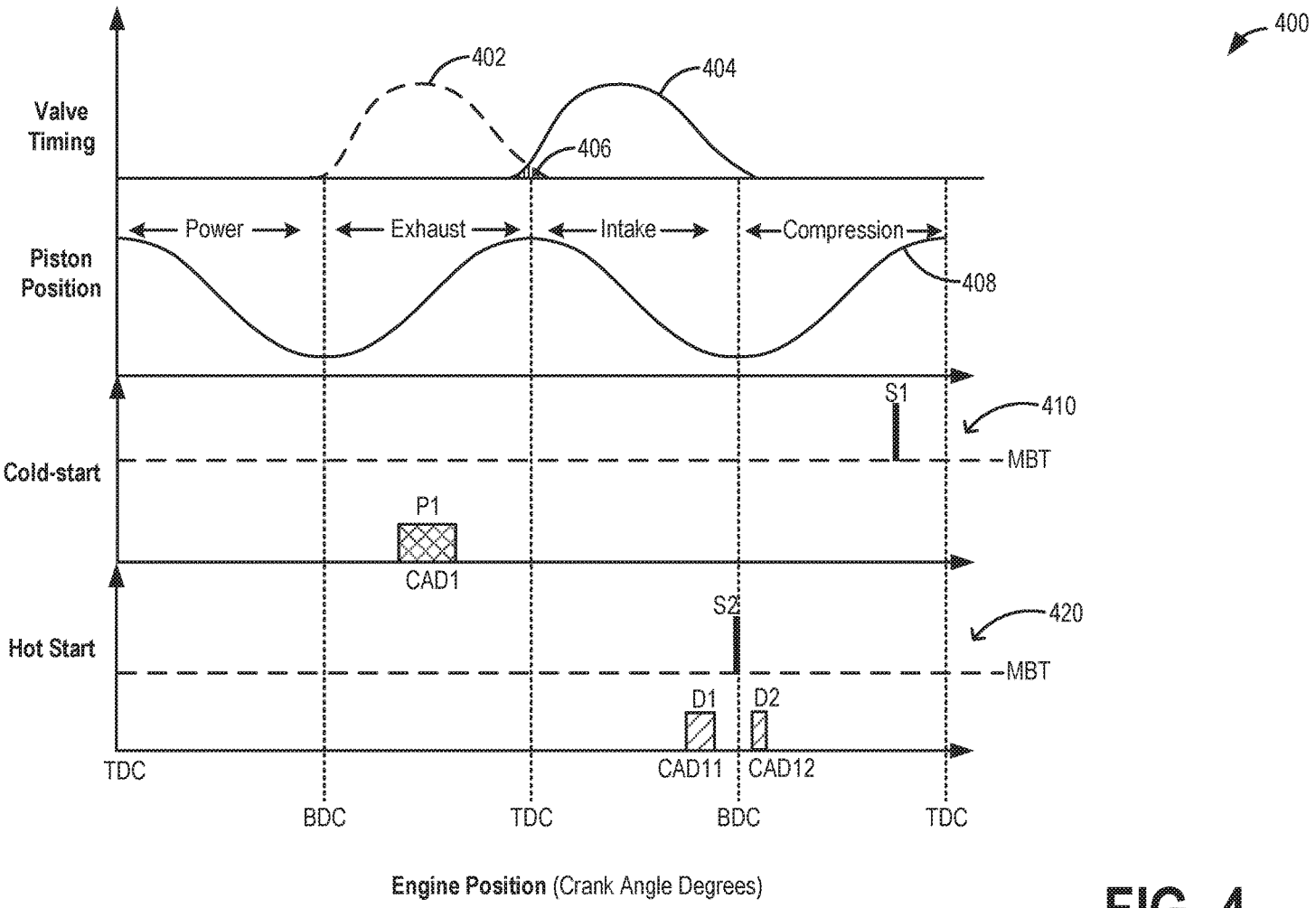
FIG. 4 shows example fuel injection profiles that may be applied via the fuel system of FIG. 2 during an engine cold-start operation.
Figure 5:
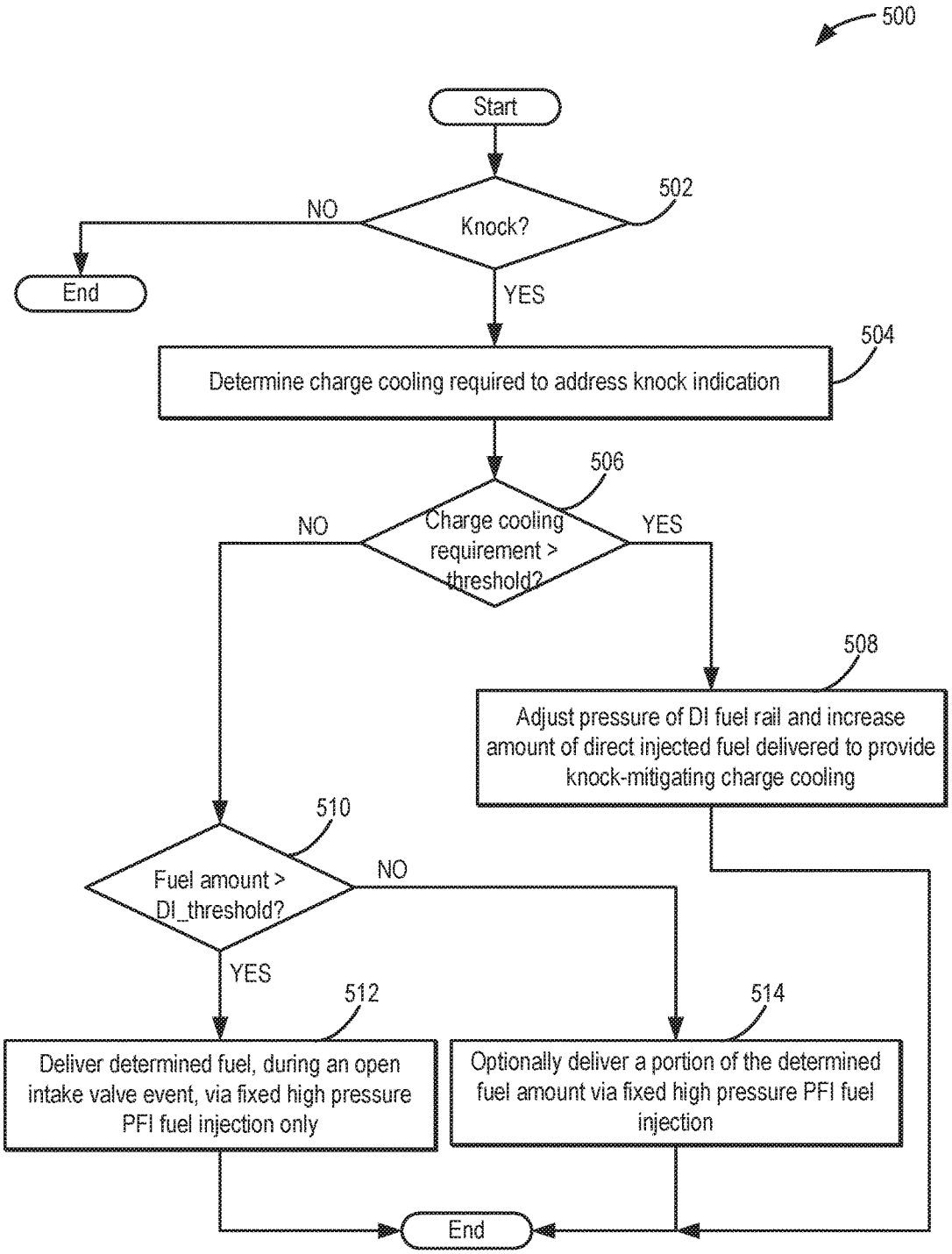
FIG. 5 depicts a flow chart of a method for selecting between high pressure port injection and high pressure direct injection to provide charge cooling to address cylinder knock.
Figure 6:
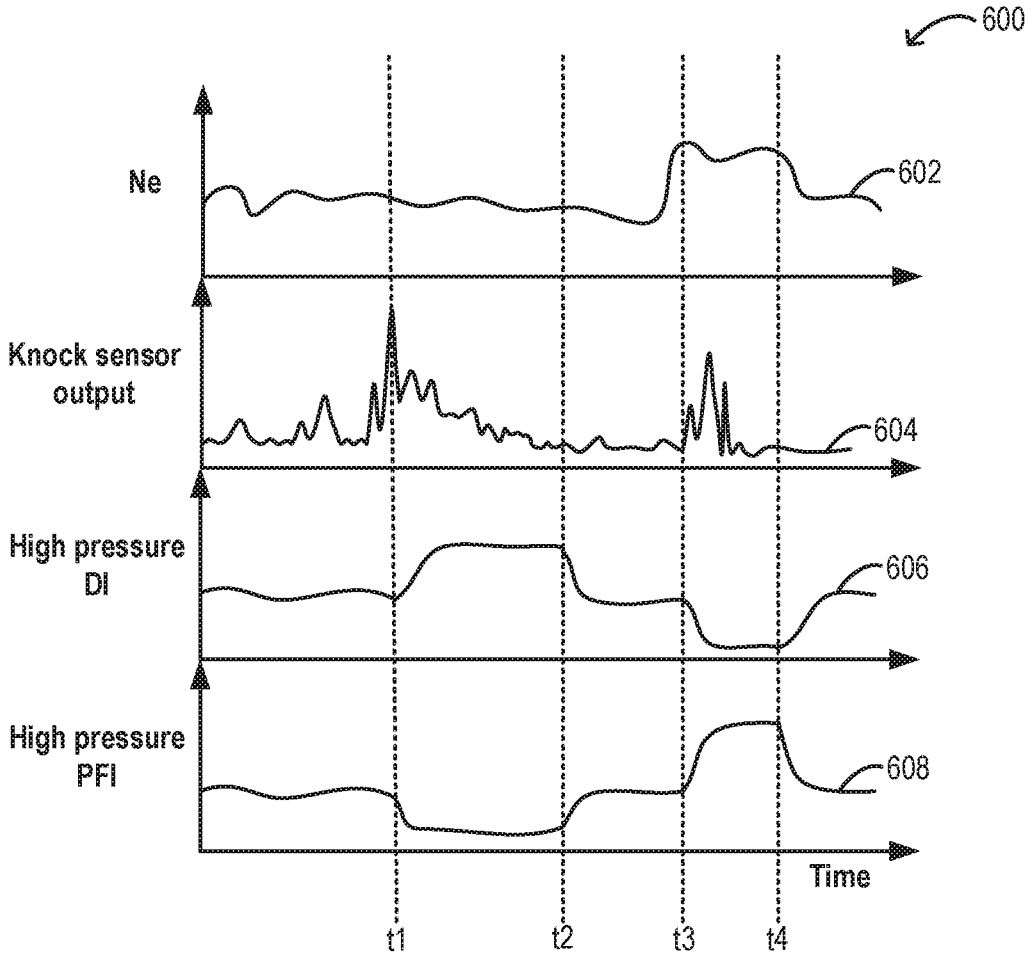
FIG. 6 shows an example fuel injection adjustment using high pressure port and direct injection to address cylinder knock, according to the present disclosure.

The following detailed description provides information regarding a high pressure fuel pump and a system for mechanically-regulating the pressure in each of a port and direct fuel rail. An example embodiment of a cylinder in an internal combustion engine is given in FIG. 1 while FIG. 2 depicts a fuel system that may be used with the engine of FIG. 1. The high pressure pump with mechanical pressure regulation and related fuel system components shown in detail at FIG. 2 enables the port injection fuel rail to be operated at a pressure higher than the default pressure of a lift pump while concurrently enabling the direct injection fuel rail to be operated in a variable high pressure range. A method for selecting fuel injection modes and regulating pressures of at least the direct injection rail is shown with reference to FIG. 3. For example, port injection may be used at a cold start due to the limited dynamic range of the high pressure direct injectors during those conditions, as shown at FIG. 4. In addition, as shown at FIG. 5, a knock mitigating fuel injection may be adjusted between the high pressure port injection and high pressure direct injection based on charge cooling requirements to overcome issues associated with the dynamic range of the direct injector at different operating conditions. An example fuel injection adjustment is shown at FIG. 6.

Regarding terminology used throughout this detailed description, a high pressure pump, or direct injection pump, may be abbreviated as a DI or HP pump. Similarly, a low pressure pump, or lift pump, may be abbreviated as a LP pump. Port fuel injection may be abbreviated as PFI while direct injection may be abbreviated as DI. Also, fuel rail pressure, or the value of pressure of fuel within a fuel rail, may be abbreviated as FRP. Also, the mechanically operated inlet check valve for controlling fuel flow into the HP pump may also be referred to as the spill valve. As discussed in more detail below, an HP pump that relies on mechanical pressure regulation without use of an electronically-controlled inlet valve may be referred to as a mechanically-controlled HP pump, or HP pump with mechanically-regulated pressure. Mechanically-controlled HP pumps, while not using electronically-controlled inlet valves for regulating a volume of fuel pumped, may provide one or more discrete pressures based on electronic selection.

Figure 1:
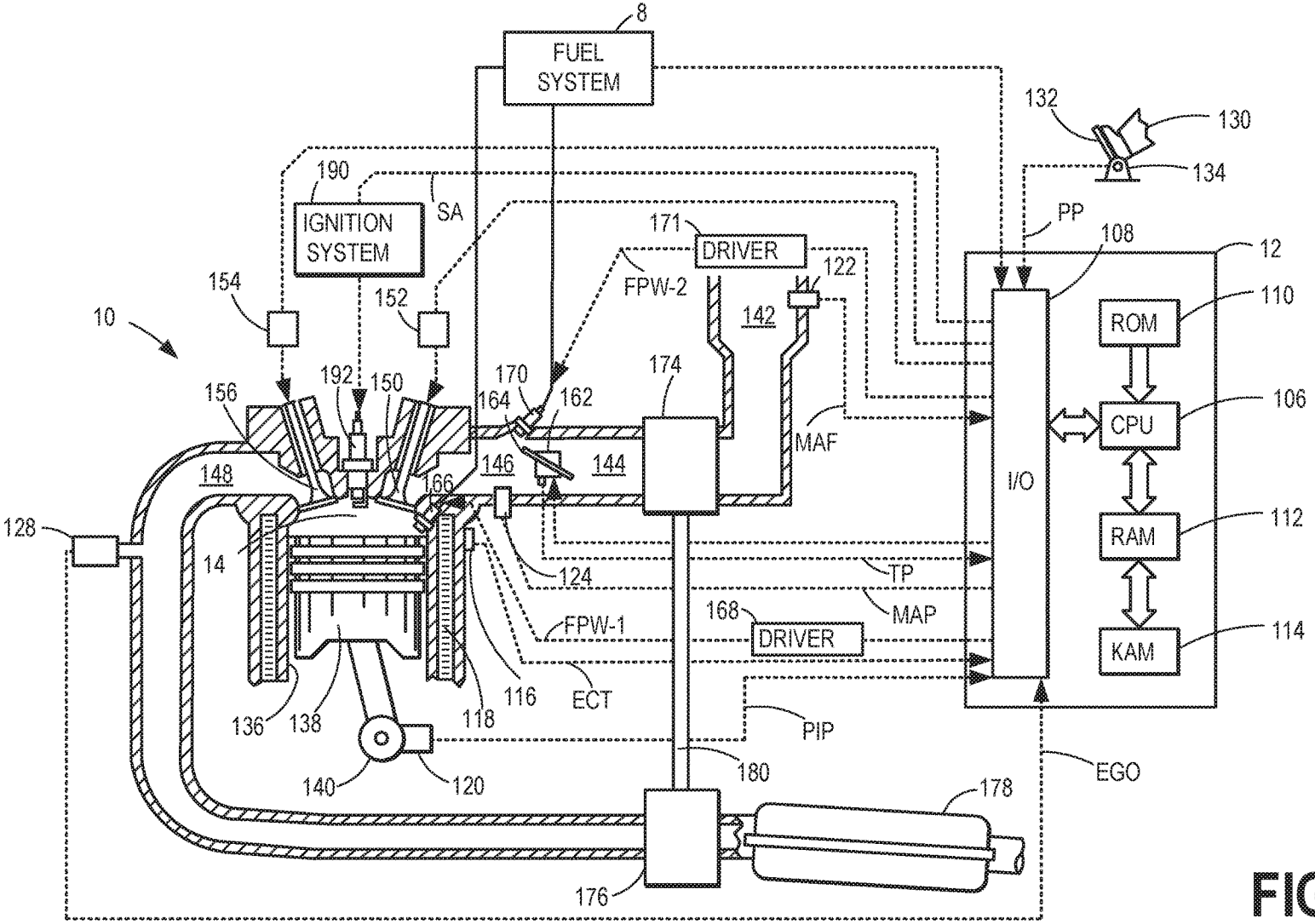
FIG. 1 schematically depicts an example embodiment of a cylinder of an internal combustion engine.
Figure 2:
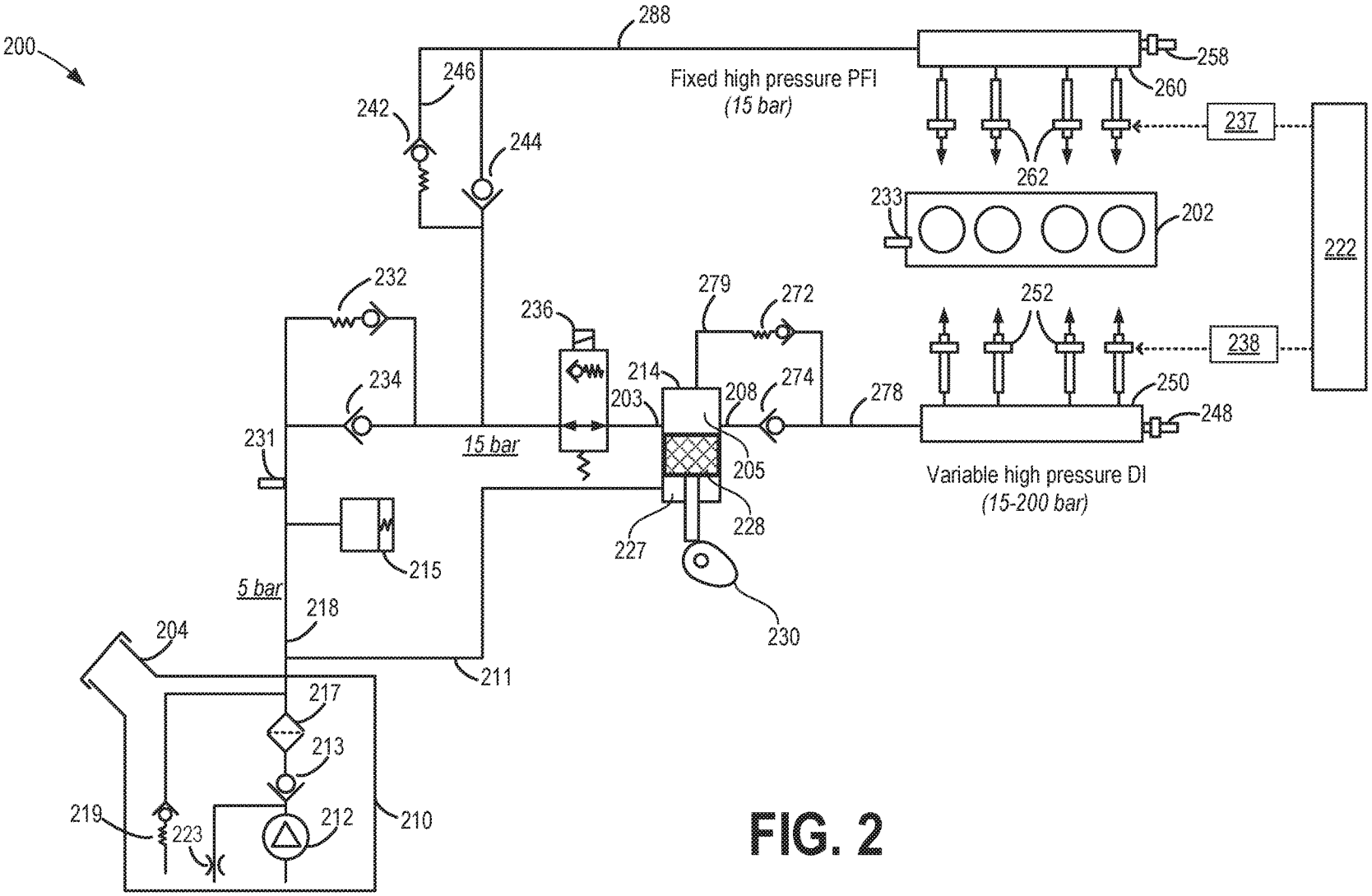
FIG. 2 schematically depicts an example embodiment of a fuel system, configured for mechanically-regulated high pressure port injection and high pressure direct injection that may be used with the engine of FIG. 1.

FIG. 1 depicts an example of a combustion chamber or cylinder of internal combustion engine 10. Engine 10 may be controlled at least partially by a control system including controller 12 and by input from a vehicle operator 130 via an input device 132. In this example, input device 132 includes an accelerator pedal and a pedal position sensor 134 for generating a proportional pedal position signal PP. Cylinder (herein also "combustion chamber") 14 of engine 10 may include combustion chamber walls 136 with piston 138 positioned therein. Piston 138 may be coupled to crankshaft 140 so that reciprocating motion of the piston is translated into rotational motion of the crankshaft. Crankshaft 140 may be coupled to at least one drive wheel of the passenger vehicle via a transmission system. Further, a starter motor (not shown) may be coupled to crankshaft 140 via a flywheel to enable a starting operation of engine 10.

Cylinder 14 can receive intake air via a series of intake air passages 142, 144, and 146. Intake air passage 146 can communicate with other cylinders of engine 10 in addition to cylinder 14. In some examples, one or more of the intake passages may include a boosting device such as a turbocharger or a supercharger. For example, FIG. 1 shows engine 10 configured with a turbocharger including a compressor 174 arranged between intake passages 142 and 144, and an exhaust turbine 176 arranged along exhaust passage 148. Compressor 174 may be at least partially powered by exhaust turbine 176 via a shaft 180 where the boosting device is configured as a turbocharger. However, in other examples, such as where engine 10 is provided with a supercharger, exhaust turbine 176 may be optionally omitted, where compressor 174 may be powered by mechanical input from a motor or the engine. A throttle 162 including a throttle plate 164 may be provided along an intake passage of the engine for varying the flow rate and/or pressure of intake air provided to the engine cylinders. For example, throttle 162 may be positioned downstream of compressor 174 as shown in FIG. 1, or alternatively may be provided upstream of compressor 174.

Exhaust passage 148 can receive exhaust gases from other cylinders of engine 10 in addition to cylinder 14. Exhaust gas sensor 128 is shown coupled to exhaust passage 148 upstream of emission control device 178. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example. Emission control device 178 may be a three way catalyst (TWC), NOx trap, various other emission control devices, or combinations thereof.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder.

Intake valve 150 may be controlled by controller 12 via actuator 152. Similarly, exhaust valve 156 may be controlled by controller 12 via actuator 154. During some conditions, controller 12 may vary the signals provided to actuators 152 and 154 to control the opening and closing of the respective intake and exhaust valves. The position of intake valve 150 and exhaust valve 156 may be determined by respective valve position sensors (not shown). The valve actuators may be of the electric valve actuation type or cam actuation type, or a combination thereof. The intake and exhaust valve timing may be controlled concurrently or any of a possibility of variable intake cam timing, variable exhaust cam timing, dual independent variable cam timing or fixed cam timing may be used. Each cam actuation system may include one or more cams and may utilize one or more of cam profile switching (CPS), variable cam timing (VCT), variable valve timing (VVT) and/or variable valve lift (VVL) systems that may be operated by controller 12 to vary valve operation. For example, cylinder 14 may alternatively include an intake valve controlled via electric valve actuation and an exhaust valve controlled via cam actuation including CPS and/or VCT. In other examples, the intake and exhaust valves may be controlled by a common valve actuator or actuation system, or a variable valve timing actuator or actuation system.

Cylinder 14 can have a compression ratio, which is the ratio of volumes when piston 138 is at bottom center to top center. In one example, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some examples, each cylinder of engine 10 may include a spark plug 192 for initiating combustion. Ignition system 190 can provide an ignition spark to combustion chamber 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

In some examples, each cylinder of engine 10 may be configured with one or more fuel injectors for providing fuel thereto. As a non-limiting example, cylinder 14 is shown including two fuel injectors 166 and 170. Fuel injectors 166 and 170 may be configured to deliver fuel received from fuel system 8. As elaborated with reference to FIGS. 2 and 3, fuel system 8 may include one or more fuel tanks, fuel pumps, and fuel rails. Fuel injector 166 is shown coupled directly to cylinder 14 for injecting fuel directly therein in proportion to the pulse width of signal FPW-1 received from controller 12 via electronic driver 168. In this manner, fuel injector 166 provides what is known as direct injection (hereafter referred to as "DI") of fuel into combustion cylinder 14. While FIG. 1 shows injector 166 positioned to one side of cylinder 14, it may alternatively be located overhead of the piston, such as near the position of spark plug 192. Such a position may improve mixing and combustion when operating the engine with an alcohol-based fuel due to the lower volatility of some alcohol-based fuels. Alternatively, the injector may be located overhead and near the intake valve to improve mixing. Fuel may be delivered to fuel injector 166 from a fuel tank of fuel system 8 via a high pressure fuel pump, and a fuel rail. Further, the fuel tank may have a pressure transducer providing a signal to controller 12.

Fuel injector 170 is shown arranged in intake passage 146, rather than in cylinder 14, in a configuration that provides what is known as port injection of fuel (hereafter referred to as "PFI") into the intake port upstream of cylinder 14. Fuel injector 170 may inject fuel, received from fuel system 8, in proportion to the pulse width of signal FPW-2 received from controller 12 via electronic driver 171. Note that a single driver 168 or 171 may be used for both fuel injection systems, or multiple drivers, for example driver 168 for fuel injector 166 and driver 171 for fuel injector 170, may be used, as depicted.

In an alternate example, each of fuel injectors 166 and 170 may be configured as direct fuel injectors for injecting fuel directly into cylinder 14. In still another example, each of fuel injectors 166 and 170 may be configured as port fuel injectors for injecting fuel upstream of intake valve 150. In yet other examples, cylinder 14 may include only a single fuel injector that is configured to receive different fuels from the fuel systems in varying relative amounts as a fuel mixture, and is further configured to inject this fuel mixture either directly into the cylinder as a direct fuel injector or upstream of the intake valves as a port fuel injector. As such, it should be appreciated that the fuel systems described herein should not be limited by the particular fuel injector configurations described herein by way of example.

Fuel may be delivered by both injectors to the cylinder during a single cycle of the cylinder. For example, each injector may deliver a portion of a total fuel injection that is combusted in cylinder 14. Further, the distribution and/or relative amount of fuel delivered from each injector may vary with operating conditions, such as engine load, knock, and exhaust temperature, such as described herein below. The port injected fuel may be delivered during an open intake valve event, closed intake valve event (e.g., substantially before the intake stroke), as well as during both open and closed intake valve operation. Similarly, directly injected fuel may be delivered during an intake stroke, as well as partly during a previous exhaust stroke, during the intake stroke, and partly during the compression stroke, for example. As such, even for a single combustion event, injected fuel may be injected at different timings from the port and direct injector. Furthermore, for a single combustion event, multiple injections of the delivered fuel may be performed per cycle. The multiple injections may be performed during the compression stroke, intake stroke, or any appropriate combination thereof.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

Fuel injectors 166 and 170 may have different characteristics. These include differences in size, for example, one injector may have a larger injection hole than the other. Other differences include, but are not limited to, different spray angles, different operating temperatures, different targeting, different injection timing, different spray characteristics, different locations etc. Moreover, depending on the distribution ratio of injected fuel among injectors 170 and 166, different effects may be achieved.

Fuel tanks in fuel system 8 may hold fuels of different fuel types, such as fuels with different fuel qualities and different fuel compositions. The differences may include different alcohol content, different water content, different octane, different heats of vaporization, different fuel blends, and/or combinations thereof etc. One example of fuels with different heats of vaporization could include gasoline as a first fuel type with a lower heat of vaporization and ethanol as a second fuel type with a greater heat of vaporization. In another example, the engine may use gasoline as a first fuel type and an alcohol containing fuel blend such as E85 (which is approximately 85% ethanol and 15% gasoline) or M85 (which is approximately 85% methanol and 15% gasoline) as a second fuel type. Other feasible substances include water, methanol, a mixture of alcohol and water, a mixture of water and methanol, a mixture of alcohols, etc.

In still another example, both fuels may be alcohol blends with varying alcohol composition wherein the first fuel type may be a gasoline alcohol blend with a lower concentration of alcohol, such as E10 (which is approximately 10% ethanol), while the second fuel type may be a gasoline alcohol blend with a greater concentration of alcohol, such as E85 (which is approximately 85% ethanol). Additionally, the first and second fuels may also differ in other fuel qualities such as a difference in temperature, viscosity, octane number, etc. Moreover, fuel characteristics of one or both fuel tanks may vary frequently, for example, due to day to day variations in tank refilling.

Controller 12 is shown in FIG. 1 as a microcomputer, including microprocessor unit 106, input/output ports 108, an electronic storage medium for executable programs and calibration values shown as non-transitory read only memory chip 110 in this particular example for storing executable instructions, random access memory 112, keep alive memory 114, and a data bus. Controller 12 may receive various signals from sensors coupled to engine 10, in addition to those signals previously discussed, including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; and absolute manifold pressure signal (MAP) from sensor 124. Engine speed signal, RPM, may be generated by controller 12 from signal PIP. Manifold pressure signal MAP from a manifold pressure sensor may be used to provide an indication of vacuum, or pressure, in the intake manifold.

FIG. 2 schematically depicts an example embodiment 200 of a fuel system, such as fuel system 8 of FIG. 1. Fuel system 200 may be operated to deliver fuel to an engine, such as engine 10 of FIG. 1. Fuel system 200 may be operated by a controller to perform some or all of the operations described with reference to the process flows of FIG. 4.

Fuel system 200 includes a fuel storage tank 210 for storing the fuel on-board the vehicle, a lower pressure fuel pump (LPP) 212 (herein also referred to as fuel lift pump 212), and a higher pressure fuel pump (HPP) 214 (herein also referred to as fuel injection pump 214). Fuel may be provided to fuel tank 210 via fuel filling passage 204. In one example, LPP 212 may be an electrically-powered lower pressure fuel pump disposed at least partially within fuel tank 210. LPP 212 may be operated by a controller 222 (e.g., controller 12 of FIG. 1) to provide fuel to HPP 214 via fuel passage 218. LPP 212 can be configured as what may be referred to as a fuel lift pump. As one example, LPP 212 may be a turbine (e.g., centrifugal) pump including an electric (e.g., DC) pump motor, whereby the pressure increase across the pump and/or the volumetric flow rate through the pump may be controlled by varying the electrical power provided to the pump motor, thereby increasing or decreasing the motor speed. For example, as the controller reduces the electrical power that is provided to lift pump 212, the volumetric flow rate and/or pressure increase across the lift pump may be reduced. The volumetric flow rate and/or pressure increase across the pump may be increased by increasing the electrical power that is provided to lift pump 212. As one example, the electrical power supplied to the lower pressure pump motor can be obtained from an alternator or other energy storage device on-board the vehicle (not shown), whereby the control system can control the electrical load that is used to power the lower pressure pump. Thus, by varying the voltage and/or current provided to the lower pressure fuel pump, the flow rate and pressure of the fuel provided at the inlet of the higher pressure fuel pump 214 is adjusted.

LPP 212 may be fluidly coupled to a filter 217, which may remove small impurities contained in the fuel that could potentially damage fuel handling components. A check valve 213, which may facilitate fuel delivery and maintain fuel line pressure, may be positioned fluidly upstream of filter 217. With check valve 213 upstream of the filter 217, the compliance of low-pressure passage 218 may be increased since the filter may be physically large in volume. Furthermore, a pressure relief valve 219 may be employed to limit the fuel pressure in low-pressure passage 218 (e.g., the output from lift pump 212). Relief valve 219 may include a ball and spring mechanism that seats and seals at a specified pressure differential, for example. The pressure differential set-point at which relief valve 219 may be configured to open may assume various suitable values; as a non-limiting example the set-point may be 6.4 bar or 5 bar (g). An orifice 223 may be utilized to allow for air and/or fuel vapor to bleed out of the lift pump 212. This bleed at 223 may also be used to power a jet pump used to transfer fuel from one location to another within the tank 210. In one example, an orifice check valve (not shown) may be placed in series with orifice 223. In some embodiments, fuel system 8 may include one or more (e.g., a series) of check valves fluidly coupled to low-pressure fuel pump 212 to impede fuel from leaking back upstream of the valves. In this context, upstream flow refers to fuel flow traveling from fuel rails 250, 260 towards LPP 212 while downstream flow refers to the nominal fuel flow direction from the LPP towards the HPP 214 and thereon to the fuel rails.

Fuel lifted by LPP 212 may be supplied at a lower pressure into a fuel passage 218 leading to an inlet 203 of HPP 214. HPP 214 may then deliver fuel into a first fuel rail 250 coupled to one or more fuel injectors of a first group of direct injectors 252 (herein also referred to as a first injector group). Fuel lifted by the LPP 212 may also be supplied to a second fuel rail 260 coupled to one or more fuel injectors of a second group of port injectors 262 (herein also referred to as a second injector group). As elaborated below, HPP 214 may be operated to raise the pressure of fuel delivered to each of the first and second fuel rail above the lift pump pressure, with the first fuel rail coupled to the direct injector group operating with a variable high pressure while the second fuel rail coupled to the port injector group operates with a fixed high pressure. As a result, high pressure port and direct injection may be enabled. The high pressure fuel pump is coupled downstream of the low pressure lift pump with no additional pump positioned in between the high pressure fuel pump and the low pressure lift pump.

While each of first fuel rail 250 and second fuel rail 260 are shown dispensing fuel to four fuel injectors of the respective injector group 252, 262, it will be appreciated that each fuel rail 250, 260 may dispense fuel to any suitable number of fuel injectors. As one example, first fuel rail 250 may dispense fuel to one fuel injector of first injector group 252 for each cylinder of the engine while second fuel rail 260 may dispense fuel to one fuel injector of second injector group 262 for each cylinder of the engine. Controller 222 can individually actuate each of the port injectors 262 via a port injection driver 237 and actuate each of the direct injectors 252 via a direct injection driver 238. The controller 222, the drivers 237, 238 and other suitable engine system controllers can comprise a control system. While the drivers 237, 238 are shown external to the controller 222, it should be appreciated that in other examples, the controller 222 can include the drivers 237, 238 or can be configured to provide the functionality of the drivers 237, 238. Controller 222 may include additional components not shown, such as those included in controller 12 of FIG. 1.

HPP 214 may be an engine-driven, positive-displacement pump. As one non-limiting example, HPP 214 may be a BOSCH HDP5 HIGH PRESSURE PUMP, which utilizes a solenoid activated control valve (e.g., fuel volume regulator, magnetic solenoid valve, etc.) 236 to vary the effective pump volume of each pump stroke. The outlet check valve of HPP is mechanically controlled and not electronically controlled by an external controller. HPP 214 may be mechanically driven by the engine in contrast to the motor driven LPP 212. HPP 214 includes a pump piston 228, a pump compression chamber 205 (herein also referred to as compression chamber), and a step-room 227. Pump piston 228 receives a mechanical input from the engine crank shaft or cam shaft via cam 230, thereby operating the HPP according to the principle of a cam-driven single-cylinder pump. A sensor (not shown in FIG. 2) may be positioned near cam 230 to enable determination of the angular position of the cam (e.g., between 0 and 360 degrees), which may be relayed to controller 222.

Fuel system 200 may optionally further include accumulator 215. When included, accumulator 215 may be positioned downstream of lower pressure fuel pump 212 and upstream of higher pressure fuel pump 214, and may be configured to hold a volume of fuel that reduces the rate of fuel pressure increase or decrease between fuel pumps 212 and 214. For example, accumulator 215 may be coupled in fuel passage 218, as shown, or in a bypass passage 211 coupling fuel passage 218 to the step-room 227 of HPP 214. The volume of accumulator 215 may be sized such that the engine can operate at idle conditions for a predetermined period of time between operating intervals of lower pressure fuel pump 212. For example, accumulator 215 can be sized such that when the engine idles, it takes one or more minutes to deplete pressure in the accumulator to a level at which higher pressure fuel pump 214 is incapable of maintaining a sufficiently high fuel pressure for fuel injectors 252, 262. Accumulator 215 may thus enable an intermittent operation mode (or pulsed mode) of lower pressure fuel pump 212. By reducing the frequency of LPP operation, power consumption is reduced. In other embodiments, accumulator 215 may inherently exist in the compliance of fuel filter 217 and fuel passage 218, and thus may not exist as a distinct element.

A lift pump fuel pressure sensor 231 may be positioned along fuel passage 218 between lift pump 212 and higher pressure fuel pump 214. In this configuration, readings from sensor 231 may be interpreted as indications of the fuel pressure of lift pump 212 (e.g., the outlet fuel pressure of the lift pump) and/or of the inlet pressure of higher pressure fuel pump. Readings from sensor 231 may be used to assess the operation of various components in fuel system 200, to determine whether sufficient fuel pressure is provided to higher pressure fuel pump 214 so that the higher pressure fuel pump ingests liquid fuel and not fuel vapor, and/or to minimize the average electrical power supplied to lift pump 212. While lift pump fuel pressure sensor 231 is shown as being positioned downstream of accumulator 215, in other embodiments the sensor may be positioned upstream of the accumulator.

First fuel rail 250 includes a first fuel rail pressure sensor 248 for providing an indication of direct injection fuel rail pressure to the controller 222. Likewise, second fuel rail 260 includes a second fuel rail pressure sensor 258 for providing an indication of port injection fuel rail pressure to the controller 222. An engine speed sensor 233 can be used to provide an indication of engine speed to the controller 222. The indication of engine speed can be used to identify the speed of higher pressure fuel pump 214, since the pump 214 is mechanically driven by the engine 202, for example, via the crankshaft or camshaft.

First fuel rail 250 is coupled to an outlet 208 of HPP 214 along fuel passage 278. In comparison, second fuel rail 260 is coupled to an inlet 203 of HPP 214 via fuel passage 288. A check valve and a pressure relief valve may be positioned between the outlet 208 of the HPP 214 and the first fuel rail. In addition, pressure relief valve 272, arranged parallel to check valve 274 in bypass passage 279, may limit the pressure in fuel passage 278, downstream of HPP 214 and upstream of first fuel rail 250. For example, pressure relief valve 272 may limit the pressure in fuel passage 278 to 200 bar. As such, pressure relief valve 272 may limit the pressure that would otherwise be generated in fuel passage 278 if control valve 236 were (intentionally or unintentionally) open and while high pressure fuel pump 214 were pumping.

One or more check valves and pressure relief valves may also be coupled to fuel passage 218, downstream of LPP 212 and upstream of HPP 214. For example, check valve 234 may be provided in fuel passage 218 to reduce or prevent back-flow of fuel from high pressure pump 214 to low pressure pump 212 and fuel tank 210. In addition, pressure relief valve 232 may be provided in a bypass passage, positioned parallel to check valve 234. Pressure relief valve 232 may limit the pressure to its left to 10 bar higher than the pressure at sensor 231.

Controller 222 may be configured to regulate fuel flow into HPP 214 through control valve 236 by energizing or de-energizing the solenoid valve (based on the solenoid valve configuration) in synchronism with the driving cam. Accordingly, the solenoid activated control valve 236 may be operated in a first mode where the valve 236 is positioned within HPP inlet 203 to limit (e.g. inhibit) the amount of fuel traveling through the solenoid activated control valve 236. Depending on the timing of the solenoid valve actuation, the volume transferred to the fuel rail 250 is varied. The solenoid valve may also be operated in a second mode where the solenoid activated control valve 236 is effectively disabled and fuel can travel upstream and downstream of the valve, and in and out of HPP 214.

As such, solenoid activated control valve 236 may be configured to regulate the mass (or volume) of fuel compressed into the direct injection fuel pump. In one example, controller 222 may adjust a closing timing of the solenoid pressure control check valve to regulate the mass of fuel compressed. For example, a late pressure control valve closing may reduce the amount of fuel mass ingested into compression chamber 205. The solenoid activated check valve opening and closing timings may be coordinated with respect to stroke timings of the direct injection fuel pump.

Pressure relief valve 232 allows fuel flow out of solenoid activated control valve 236 toward the LPP 212 when pressure between pressure relief valve 232 and solenoid operated control valve 236 is greater than a predetermined pressure (e.g., 10 bar). When solenoid operated control valve 236 is deactivated (e.g., not electrically energized), solenoid operated control valve operates in a pass-through mode and pressure relief valve 232 regulates pressure in compression chamber 205 to the single pressure relief set-point of pressure relief valve 232 (e.g., 10 bar above the pressure at sensor 231). Regulating the pressure in compression chamber 205 allows a pressure differential to form from the piston top to the piston bottom. The pressure in step-room 227 is at the pressure of the outlet of the low pressure pump (e.g., 5 bar) while the pressure at piston top is at pressure relief valve regulation pressure (e.g., 15 bar). The pressure differential allows fuel to seep from the piston top to the piston bottom through the clearance between the piston and the pump cylinder wall, thereby lubricating HPP 214.

Piston 228 reciprocates up and down. HPP 214 is in a compression stroke when piston 228 is traveling in a direction that reduces the volume of compression chamber 205. HPP 214 is in a suction stroke when piston 228 is traveling in a direction that increases the volume of compression chamber 205.

A forward flow outlet check valve 274 may be coupled downstream of an outlet 208 of the compression chamber 205. Outlet check valve 274 opens to allow fuel to flow from the high pressure pump outlet 208 into a fuel rail only when a pressure at the outlet of direct injection fuel pump 214 (e.g., a compression chamber outlet pressure) is higher than the fuel rail pressure. Thus, during conditions when direct injection fuel pump operation is not requested, controller 222 may deactivate solenoid activated control valve 236 and pressure relief valve 232 regulates pressure in compression chamber 205 to a single substantially constant pressure during most of the compression stroke. On the intake stroke the pressure in compression chamber 205 drops to a pressure near the pressure of the lift pump (212). Lubrication of DI pump 214 may occur when the pressure in compression chamber 205 exceeds the pressure in step-room 227. This difference in pressures may also contribute to pump lubrication when controller 222 deactivates solenoid activated control valve 236. One result of this regulation method is that the fuel rail is regulated to a minimum pressure, approximately the pressure relief of pressure relief valve 232. Thus, if pressure relief valve 232 has a pressure relief setting of 10 bar, the fuel rail pressure becomes 15 bar because this 10 bar adds to the 5 bar of lift pump pressure. Specifically, the fuel pressure in compression chamber 205 is regulated during the compression stroke of direct injection fuel pump 214. Thus, during at least the compression stroke of direct injection fuel pump 214, lubrication is provided to the pump. When direct fuel injection pump enters a suction stroke, fuel pressure in the compression chamber may be reduced while still some level of lubrication may be provided as long as the pressure differential remains. Another pressure relief valve 272 may be placed in parallel with check valve 274. Pressure relief valve 272 allows fuel flow out of the DI fuel rail 250 toward pump outlet 208 when the fuel rail pressure is greater than a predetermined pressure.

As such, while the direct injection fuel pump is reciprocating, the flow of fuel between the piston and bore ensures sufficient pump lubrication and cooling.

The lift pump may be transiently operated in a pulsed mode where the lift pump operation is adjusted based on a pressure estimated at the outlet of the lift pump and inlet of the high pressure pump. In particular, responsive to high pressure pump inlet pressure falling below a fuel vapor pressure, the lift pump may be operated until the inlet pressure is at or above the fuel vapor pressure. This reduces the risk of the high pressure fuel pump ingesting fuel vapors (instead of fuel) and ensuing engine stall events.

It is noted here that the high pressure pump 214 of FIG. 2 is presented as an illustrative example of one possible configuration for a high pressure pump. Components shown in FIG. 2 may be removed and/or changed while additional components not presently shown may be added to pump 214 while still maintaining the ability to deliver high-pressure fuel to a direct injection fuel rail and a port injection fuel rail.

Solenoid activated control valve 236 may also be operated to direct fuel back-flow from the high pressure pump to one of pressure relief valve 232 and accumulator 215. For example, control valve 236 may be operated to generate and store fuel pressure in accumulator 215 for later use. One use of accumulator 215 is to absorb fuel volume flow that results from the opening of compression pressure relief valve 232. Accumulator 227 sources fuel as check valve 234 opens during the intake stroke of pump 214. Another use of accumulator 215 is to absorb/source the volume changes in the step room 227. Yet another use of accumulator 215 is to allow intermittent operation of lift pump 212 to gain an average pump input power reduction over continuous operation.

While the first direct injection fuel rail 250 is coupled to the outlet 208 of HPP 214 (and not to the inlet of HPP 214), second port injection fuel rail 260 is coupled to the inlet 203 of HPP 214 (and not to the outlet of HPP 214). Although inlets, outlets, and the like relative to compression chamber 205 are described herein, it may be appreciated that there may be a single conduit into compression chamber 205. The single conduit may serve as inlet and outlet. In particular, second fuel rail 260 is coupled to HPP inlet 203 at a location upstream of solenoid activated control valve 236 and downstream of check valve 234 and pressure relief valve 232. Further, no additional pump may be required between lift pump 212 and the port injection fuel rail 260. As elaborated below, the specific configuration of the fuel system with the port injection fuel rail coupled to the inlet of the high pressure pump via a pressure relief valve and a check valve enables the pressure at the second fuel rail to be raised via the high pressure pump to a fixed default pressure that is above the default pressure of the lift pump. That is, the fixed high pressure at the port injection fuel rail is derived from the high pressure piston pump.

When the high pressure pump 214 is not reciprocating, such as at key-up before cranking, check valve 244 allows the second fuel rail to fill at 5 bar. As the pump chamber displacement becomes smaller due to the piston moving upward, the fuel flows in one of two directions. If the spill valve 236 is closed, the fuel goes into the high pressure fuel rail 250. If the spill valve 236 is open, the fuel goes either into the low pressure fuel rail 250 or through the compression relief valve 232. In this way, the high pressure fuel pump is operated to deliver fuel at a variable high pressure (such as between 15-200 bar) to the direct fuel injectors 252 via the first fuel rail 250 while also delivering fuel at a fixed high pressure (such as at 15 bar) to the port fuel injectors 262 via the second fuel rail 260. The variable pressure may include a minimum pressure that is at the fixed pressure (as in the system of FIG. 2). In the configuration depicted at FIG. 2, the fixed pressure of the port injection fuel rail is the same as the minimum pressure for the direct injection fuel rail, both being higher than the default pressure of the lift pump. Herein, the fuel delivery from the high pressure pump is controlled via the upstream (solenoid activated) control valve and further via the various check valve and pressure relief valves coupled to the inlet of the high pressure pump. By adjusting operation of the solenoid activated control valve, the fuel pressure at the first fuel rail is raised from the fixed pressure to the variable pressure while maintaining the fixed pressure at the second fuel rail. Valves 244 and 242 work in conjunction to keep the low pressure fuel rail 260 pressurized to 15 bar during the pump inlet stroke. Pressure relief valve 242 simply limits the pressure that can build in fuel rail 250 due to thermal expansion of fuel. A typical pressure relief setting may be 20 bar.

Controller 12 can also control the operation of each of fuel pumps 212, and 214 to adjust an amount, pressure, flow rate, etc., of a fuel delivered to the engine. As one example, controller 12 can vary a pressure setting, a pump stroke amount, a pump duty cycle command and/or fuel flow rate of the fuel pumps to deliver fuel to different locations of the fuel system. A driver (not shown) electronically coupled to controller 222 may be used to send a control signal to the low pressure pump, as required, to adjust the output (e.g. speed) of the low pressure pump.

Figure 3:
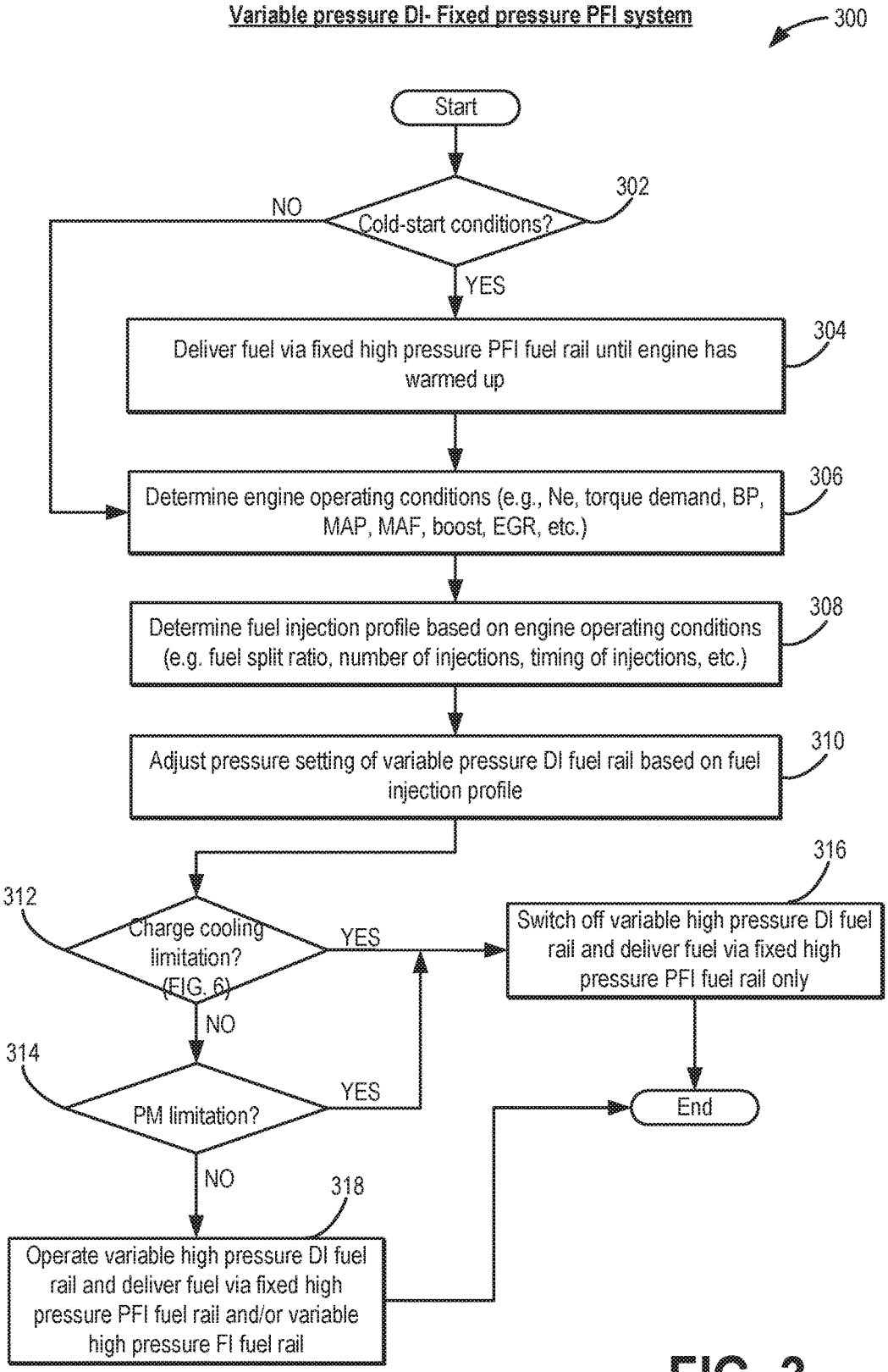
FIG. 3 depicts a flow chart of a method for operating a high pressure pump to provide a fixed high pressure at a port injection fuel rail and a variable high pressure at a direct injection fuel rail.

Now turning to FIG. 3, an example routine 300 is shown for operating a high pressure fuel injection pump to deliver fuel at high pressure to each of a fuel rail coupled to port injectors and a fuel rail coupled to direct injectors. The method allows the port injectors to be operated with a fixed high pressure while the direct injectors are operated with a variable high pressure. The method also enables higher pressure port injection to be used for delivering fuel to an engine cylinder during conditions when fuel delivery via the direct injector is limited, such as due to the need for very low direct injection pulse-widths.

At 302, it may be determined if engine cold-start conditions are present. In one example, engine cold start conditions may be confirmed if the engine temperature is below a threshold, exhaust catalyst temperature is below a light-off temperature, ambient temperature is below a threshold, and/or a threshold duration has elapsed since a prior engine-off event. If cold-start conditions are confirmed, then at 304, the routine includes, during the engine cold-start condition, for a number of combustion events since the engine start, operating the high pressure pump to port inject fuel to the engine at fixed pressure, the fuel port injected during a closed intake valve event. PFI generally has lower particulate emissions than does DI, and thus it is favorable to use PFI during cold conditions where particulate emissions are worst. That is, fuel may not be delivered to the engine for a number of combustion events during the cold-start via direct injection. At the same time, the pressure output of the high pressure fuel map may not be run higher during the cold-start due to valve sealant limits. During such cold-start conditions, by shifting to delivering fuel via a high pressure port injection, fuel may be delivered in each injection by using the port injector, and sufficient fuel atomization may be enabled via the fixed high pressure of the port injection fuel rail. Consequently, cold-start particulate emission performance of the engine is improved. An example cold start fuel injection profile is described below with reference to FIG. 4.

FIG. 4 shows a map 400 of valve timing and piston position, with respect to an engine position, for a given engine cylinder. During an engine start, while the engine is being cranked, an engine controller may be configured to adjust a fuel injection profile of fuel delivered to the cylinder. In particular, fuel may be delivered as a first profile during an engine cold-start when fuel delivery via direct fuel injectors is pulse-width limited. In comparison, fuel may be delivered as a second profile during an engine hot-start when fuel delivery via direct fuel injectors is not pulse-width limited. The fuel injection may be transitioned from the first profile to the second profile following engine cranking. The first fuel injection profile may leverage high pressure port injection, generated via the high pressure pump, to provide sufficient fuel atomization, while the second fuel injection profile may leverage high pressure direct injection, also generated via the high pressure pump, to provide sufficient fuel atomization.

Map 400 illustrates an engine position along the x-axis in crank angle degrees (CAD). Curve 408 depicts piston positions (along the y-axis), with reference to their location from top dead center (TDC) and/or bottom dead center (BDC), and further with reference to their location within the four strokes (intake, compression, power and exhaust) of an engine cycle. As indicated by sinusoidal curve 408, a piston gradually moves downward from TDC, bottoming out at BDC by the end of the power stroke. The piston then returns to the top, at TDC, by the end of the exhaust stroke. The piston then again moves back down, towards BDC, during the intake stroke, returning to its original top position at TDC by the end of the compression stroke.

Curves 402 and 404 depict valve timings for an exhaust valve (dashed curve 402) and an intake valve (solid curve 404) during a normal engine operation. As illustrated, an exhaust valve may be opened just as the piston bottoms out at the end of the power stroke. The exhaust valve may then close as the piston completes the exhaust stroke, remaining open at least until a subsequent intake stroke has commenced. In the same way, an intake valve may be opened at or before the start of an intake stroke, and may remain open at least until a subsequent compression stroke has commenced.

As a result of the timing differences between exhaust valve closing and intake valve opening, for a short duration, before the end of the exhaust stroke and after the commencement of the intake stroke, both intake and exhaust valves may be open. This period, during which both valves may be open, is referred to as a positive intake to exhaust valve overlap 406 (or simply, positive valve overlap), represented by a hatched region at the intersection of curves 402 and 404. In one example, the positive intake to exhaust valve overlap 406 may be a default cam position of the engine present during an engine cold start.

Plot 410 depicts an example fuel injection profile that may be used during an engine cold start, in an engine system configured for high pressure port and direct fuel injection via a common high pressure pump. Profile 410 may be used to improve fuel atomization and reduce an amount of engine start exhaust PM emissions without degrading engine combustion stability. As elaborated herein, injection profile 410 may be performed for a number of combustion events since an engine cold-start with only port injection of fuel and without any direct injection of fuel. However, in alternate examples, the cold-start fuel injection profile may include a larger portion of fuel being port injected and a smaller portion of fuel being direct injected.

Fuel injection profile 410 may be used during a first number of combustion events since an engine cold start. In one example, fuel injection profile 410 may be used for only the first combustion event since an engine cold-start, or an engine extreme cold-start. An engine controller is configured to operate the high pressure pump to provide the total amount of fuel to the cylinder as a single high pressure port injection P1, depicted as a hatched block. The port injection may be performed at a first timing CAD1 that includes port injection during a closed intake valve event (that is, during the exhaust stroke).

In fuel injection profile 410, no fuel is delivered as a high pressure direct injection. This is due to the direct injection fuel rail being pressure limited during the cold-start conditions. At the same time, the direct injection fuel rail pressure cannot be raised any further by increasing operation of the high pressure fuel pump due to injector sealing limits. During extreme cold, the DI injector seals cannot seal at the highest pressure and therefore, injection pressure needs to be limited. During such conditions, fuel atomization is advantageously provided by using high pressure port injection. In addition, the high pressure port injection allows the requested fuel mass to be delivered without incurring particulate matter emission issues, as may be expected with high pressure direct injection.

In addition to delivering the fuel as a single high pressure port fuel injection, a spark ignition timing may be adjusted. For example, spark timing may be advanced towards MBT during port only injection (as shown at S1) when the engine is started at extreme cold temperatures. In one example, spark timing S1 (solid bar) may be set to 12 degrees before TDC.

Plot 420 depicts an example fuel injection profile that may be used during an engine hot start, in an engine system configured for high pressure port and direct fuel injection via a common high pressure pump. Profile 420 may be used to improve fuel atomization. Injection profile 420 may be performed for a number of combustion events since an engine hot-start with only direct injection of fuel and without any port injection of fuel. However, in alternate examples, the hot-start fuel injection profile may include a larger portion of fuel being direct injected and a smaller portion of fuel being port injected.

Fuel injection profile 420 may be used during a second number of combustion events since an engine hot start, the second number larger than the first number of combustion events for which fuel injection profile 410 is applied on a cold-start. In one example, fuel injection profile 420 may be used for only the first combustion event since an engine hot-start. An engine controller is configured to operate the high pressure pump to provide the total amount of fuel to the cylinder as a multiple high pressure direct injections D1, D2, depicted as diagonally striped blocks. While the depicted example shows fuel being direct injected as two high pressure direct injections, in alternate examples, fuel may be delivered as a larger number of direct injections. The direct injections may be performed as a first intake stroke injection D1 at CAD11 and a second compression stroke injection D2 at CAD12. In the depicted example, the multiple high pressure direct injections are asymmetric with a larger amount of the total fuel mass delivered in the first intake stroke injection and a remaining smaller amount of the total fuel mass delivered in the second compression stroke injection. However this is not meant to be limiting. In alternate examples, a larger amount of the total fuel mass may be delivered in the second compression stroke injection. Further still, the injections may be symmetric with the total amount of fuel delivered as multiple injections of a fixed amount.

In fuel injection profile 420, no fuel is delivered as a high pressure port injection. This is due to the direct injection fuel rail pressure being sufficiently high during the hot-start condition. During such conditions, fuel atomization can be provided by using high pressure direct injection.

In addition to delivering the fuel as multiple high pressure direct fuel injections, a spark ignition timing may be adjusted. For example, spark timing may be retarded from MBT during the direct injection (as shown at S2) when the engine is hot restarted. In one example, spark timing S2 (solid bar) may be set to BDC.

Returning to FIG. 3, the controller may continue to deliver fuel (at 304) to the engine for a number of combustion events during the cold-start until the engine has warmed up sufficiently. For example, fuel may be only port injected until the exhaust catalyst temperature is higher than the light-off temperature. Alternatively, fuel may be only port injected until a threshold number of combustion events since the cold-start have elapsed. After the number of combustion events has elapsed, the high pressure fuel pump may be operated to direct inject fuel at a variable pressure to the engine during the cold-start over one or more intake and/or compression stroke injections. For example, fuel may be delivered as multiple intake stroke and/or multiple compression stroke injections.

If engine cold-start conditions are not confirmed (that is, the engine start is a hot start) or after the engine has been sufficiently warmed, the routine moves to 306 where engine operating conditions including engine speed, torque demand, MAP, MAF, etc., are estimated and/or measured. Then, at 308, based on the estimated operating conditions, a fuel injection profile may be determined. This may include, for example, an amount of fuel (herein also referred to as the fuel mass) to be delivered to the engine based on the determined engine operating conditions, as well as a fuel injection timing, and a fuel split ratio. The fuel split ratio may include the proportion of the total fuel mass to be delivered to an engine cylinder via direct injection relative to port injection. The fuel split ratio may also include whether the total amount of fuel is to be delivered as a single or multiple (port or direct) injections per fuel injection cycle. The fuel injection profile may further include a fuel injection pressure and a fuel injection pulse width for each injection from the port and the direct injectors.

At 310, the routine includes, if any direct injection of fuel is requested, adjusting the pressure setting of the variable high pressure fuel rail coupled to the direct injectors based on the determined fuel injection profile. For example, the pressure of the direct injection fuel rail may be increased as the pressure setting of a requested direct injection event increases.

At 312, it may be determined if are any cylinder charge cooling limitations. For example, it may be determined if charge cooling is required responsive to a cylinder knock event. While a cylinder charge cooling limit is utilized in this example, any other DI fuel limitation may be utilized. If cylinder charge cooling is required, and the charge cooling requirement is more than can be delivered by the direct injectors at the current operating conditions, a charge cooling limitation may be confirmed. In one example, if cylinder charge cooling is required at low load conditions, the direct injectors may be pulse width limited and unable to provide the desired charge cooling. Specifically, during such conditions, the direct injection fuel rail pressure may be higher than required and consequently, even a small pulse of direct injection may result in fuel enrichment. As such, the pressure of the direct injection fuel rail may not be lowered without performing a fuel injection. In another example, at high engine speed-high engine load conditions, the high pressure direct injectors may not have sufficient time to provide the requested charge cooling.

If the requested charge cooling cannot be provided by the direct fuel injectors due to insufficient direct injection time or direct injection pulse width, a charge cooling limitation may be confirmed. Accordingly, at 316, the routine includes disabling fuel delivery via the variable high pressure direct injection fuel rail and instead, delivering the requested charge cooling via the fixed high pressure port injection fuel rail only. FIGS. 5-6 elaborate an example delivery of a knock-mitigating charge cooling fuel mass via only variable high pressure direct injection during some knock conditions, and via only fixed high pressure port injection during other knock conditions.

If a charge cooling limitation is not confirmed, the routine moves to 314 to determine if the engine is particulate matter (PM) emissions limited. In one example, the engine may be PM limited during conditions when a PM load of the engine is already high. In another example, the engine may be PM limited during conditions when direct injection of fuel generates large amount of PMs, such as during an engine cold-start. If the engine is PM limited, then the routine moves back to 416 to disable fuel delivery via the variable high pressure direct injection fuel rail and instead, the routine delivers the requested fuel mass via the fixed high pressure port injection fuel rail only. By utilizing PFI, particulate emissions may be improved due to good fuel-air mixture preparation while the benefits of DI accrue at high loads. In one example a ratio of two injection modes (that is, a ratio of DI and PFI) may be utilized.

If no charge cooling or PM limitations are confirmed at 312, 314, then at 318 the routine operates the high pressure fuel pump to deliver the requested fuel mass via the variable high pressure direct injection fuel rail and/or the fixed high pressure port injection fuel rail, as determined at 308. In one example, a portion of the requested fuel may be delivered as a high pressure port injection while a remaining portion of the requested fuel may be delivered as one or more high pressure direct injections. The one or more high pressure direct injections may include one or more high pressure intake stroke injections, one or more high pressure compression stroke injections, or a combination thereof.

In this way, a fuel system method is provided wherein a high pressure fuel pump is operated to deliver fuel from a fuel tank at a variable pressure to a first fuel rail coupled to direct fuel injectors, and in response to a direct injection request being lower than a threshold, the high pressure fuel pump is operated to deliver the requested fuel mass via port fuel injectors. Herein, operating the high pressure fuel pump to deliver the requested fuel mass via port injectors includes delivering the requested fuel mass at a fixed pressure to a second fuel rail coupled to the port fuel injectors, the second fuel rail coupled to an inlet of the high pressure fuel pump, the first fuel rail coupled to an outlet of the high pressure fuel pump. The threshold may be based on the variable pressure at the first fuel rail. For example, the threshold may be decreased as the variable pressure at the first fuel rail increases. Operating the high pressure fuel pump to deliver fuel via the port injectors includes operating the high pressure fuel pump without operating a low pressure lift pump coupled between the high pressure fuel pump and a fuel tank. In another example, fuel is delivered via the high pressure fuel pump to the second fuel rail in response to a fuel mass request being higher than an injector pulse width of each of the direct and port fuel injectors. Herein, the fuel mass request being higher than an injector pulse width may include a request for exhaust enrichment.

In another example, a fuel system is provided comprising a first fuel rail coupled to a direct injector; a second fuel rail coupled to a port injector; a high pressure mechanical fuel pump delivering fuel to each of the first and second fuel rails, the high pressure fuel pump including no electrical connection to a controller, the first fuel rail coupled to an outlet of the high pressure fuel pump, the second fuel rail coupled to an inlet of the high pressure fuel pump; a solenoid activated control valve positioned upstream of the inlet of the high pressure fuel pump for varying a pressure of fuel delivered by the pump to the first fuel rail; and a mechanical pressure relief valve coupled upstream of the high pressure fuel pump, between the control valve and the second fuel rail, the pressure relief valve configured to maintain a fixed fuel pressure in the second fuel rail. The fuel system further comprises a low pressure lift pump coupled between a fuel tank and the high pressure fuel pump, wherein the mechanical pressure relief valve is configured to maintain the fixed fuel pressure in the second fuel rail above a default pressure of the lift pump via fuel back-flow from the high pressure fuel pump. During an engine cold-start condition, for a number of combustion events since engine start, the high pressure fuel pump is operated to port inject fuel at the fixed pressure during a closed intake valve event. After the number of combustion events, the high pressure fuel pump is operated to direct inject fuel at the variable pressure over multiple intake and/or compression stroke injections. Herein, the high pressure fuel pump is not electronically controlled and the high pressure fuel pump is coupled downstream of the low pressure lift pump with no intervening fuel pumps.

Now turning to FIG. 5, an example routine 500 is shown for adjusting fuel injection from a high pressure port injection fuel rail and a high pressure direct injection fuel rail responsive to an indication of knock. The method allows the charge cooling properties of a high pressure port injection to be leveraged during conditions when charge cooling from a high pressure direct injection is constrained.

At 502, the routine includes confirming an indication of knock. In one example, a cylinder knock event may be confirmed based on the output of a knock sensor estimated in a knock window for a cylinder being higher than a knock threshold. The knock window of the cylinder may include a crank angle degree window occurring at or after a spark event in the cylinder. If knock is not confirmed, the routine may end.

Upon confirming a cylinder knock event, at 504, the routine includes determining an amount of charge cooling required to address the knock indication. For example, an amount of fuel that needs to be injected into the cylinder to mitigate the knock may be determined. In addition, an amount of spark retard required to address the knock may also be determined.

At 506, it may be determined if the charge cooling requirement is higher than a threshold. In one example, as the indication of knock exceeds the knock threshold, the charge cooling required to address the knock may also correspondingly increase. Due to the higher charge cooling properties of a direct injection of fuel, relative to a port injection of fuel, direct injection may be better able to better address the knock indication when the charge cooling requirement is higher. Thus, if the charge cooling requirement is larger than a threshold, then at 508, the routine includes adjusting the pressure of the direct injection fuel rail and increasing the amount of fuel delivered to the knock affected cylinder to provide the knock mitigating charge cooling.

If the charge cooling requirement is lower than the threshold, then at 510, the fuel mass to be injected may be compared to a direct injection threshold (DI_threshold). Specifically, it may be determined if the required charge cooling direct injection fuel mass is higher than a threshold mass that can be delivered by the direct injector. As such, if the mass of fuel to be direct injected is higher than the threshold, due to the substantially high pressure of the direct injection, there may be a risk of bore wash. Therein, the large amount of high pressure fuel directly injected into the cylinder can scrape off some of the oil film on the inner surface of the combustion chamber, reducing lubrication available during piston motion and expediting cylinder degradation. If the charge cooling fuel mass requirement is higher than the threshold, then at 512, the routine includes not delivering the knock mitigating fuel mass via direct injection. Instead, the knock mitigating fuel injection may be provided via the high pressure port injector of the cylinder at the fixed high pressure during an open intake valve event. If the fuel mass is less than the threshold, then at 514, the determined charge cooling fuel mass may be delivered via the cylinder direct injector while adjusting the variable pressure of the direct injection fuel rail. Optionally, a portion of the fuel may be delivered via the high fixed pressure port injector during an open intake valve event.

It will be appreciated that while the above example suggests transitioning from a high pressure direct injection of fuel to a high pressure port injection of fuel responsive to the charge cooling fuel mass being larger than a threshold mass, in still further examples, the transitioning may occur based on variations in direct injector pulse-width limitations that are affected by changes in engine speed-load. For example, if charge cooling is requested at high speed-load conditions, the direct injector can run out of time to provide the direct injection. Therefore, the controller may provide the requested high pressure fuel injection as a high pressure port fuel injection on an open intake valve event, instead of as a high pressure direct injection, to improve charge cooling. As another example, if charge cooling is requested at low speed-load conditions, the direct injector pressure may be too high while the injection pulse width required is too low. During such conditions, the direct injection may result in undesired cylinder enrichment. Therefore, the controller may provide the requested high pressure fuel injection as a high pressure port fuel injection on an open intake valve event instead of as a high pressure direct injection.

In this way, during a first knock condition, an engine controller may operate a high pressure fuel pump to direct inject fuel at a variable pressure into an engine cylinder responsive to knock. In comparison, during a second, different knock condition, the controller may operate the high pressure fuel pump to port inject fuel at a fixed pressure into the engine cylinder responsive to knock. Herein, during the first condition, a knock-mitigating charge cooling requirement is higher while during the second condition, the knock-mitigating charge cooling requirement is lower. In an alternate example, during the first condition, a fuel mass of the injection performed responsive to knock is lower than a threshold while during the second condition, the fuel mass of the injection performed responsive to knock is higher than the threshold.

FIG. 6 shows example knock mitigating adjustments performed using high pressure port and high pressure direct fuel injections, leveraging the charge cooling properties of a direct injection when possible to address knock, while leveraging the charge cooling properties of a high pressure injection when knock cannot be addressed via a direct injection.

Map 600 depicts changes in engine speed at plot 602, a knock sensor output at plot 604, high pressure direct injection into a cylinder at plot 606, and high pressure port injection into a cylinder at plot 608. All plots are depicted with time along the x-axis.

At t0, the engine may be operating at medium speed-load conditions. Between t0 and t1, the knock sensor output may start to increase. At t1, the knock sensor output may exceed a threshold and a knock event may be confirmed. In response to the indication of knock, at t1, while the speed-load of the engine does not limit or constrain the pulse width of the high pressure direct injector, a proportion of fuel injected into the knocking cylinder as a high pressure direct injection is increased while the proportion of fuel injected into the knocking cylinder as a high pressure port injection is correspondingly decreased. Herein, the charge cooling properties of the direct fuel injection are leveraged to mitigate the knock. In the depicted example, the port injection is decreased but not disabled. However, in alternate examples, responsive to the indication of knock, the cylinder may be transiently fueled via only direct injection and no port injection.

At t2, responsive to a drop in the knock sensor output, nominal cylinder fueling with at least some port injection and at least some direct injection may be resumed and maintained until t3. At t3, the engine may be operating at high speed-load conditions. Immediately after t3, the knock sensor output may start to increase. Shortly after t3, the knock sensor output may exceed the threshold and a knock event may be confirmed. In response to the indication of knock, while the speed-load of the engine does limit and constrain the pulse width of the high pressure direct injector, a proportion of fuel injected into the knocking cylinder as a high pressure direct injection is decreased while the proportion of fuel injected into the knocking cylinder as a high pressure port injection is correspondingly increased. In addition, the port fuel injection is provided during an open intake valve event. Herein, the charge cooling properties of the port fuel injection are leveraged to mitigate the knock due to the constraints on the direct injection's pulse width. In the depicted example, the direct injection is decreased but not disabled. However, in alternate examples, responsive to the indication of knock, the cylinder may be transiently fueled via only port injection and no direct injection. At t4, responsive to a drop in the knock sensor output, nominal cylinder fueling with at least some port injection and at least some direct injection may be resumed.

In this way, the technical effect of operating a high pressure fuel pump with a port injection fuel rail coupled to the inlet of the pump and a direct injection fuel rail coupled to the outlet of the pump is that a single high pressure piston pump can be used to provide each of a variable high pressure to the direct injection fuel rail and a fixed high pressure to the port injection fuel rail. By coupling the port injection rail to the inlet of the high pressure pump via a solenoid activated control valve, a mechanical check valve, and a pressure relief valve, the port injection fuel rail pressure can be raised above the default pressure of a lift pump by leveraging the back-flow from the reciprocating piston. By enabling high pressure port injection without the need for an additional dedicated pump between the lift pump and the port injection fuel rail, high pressure port injection can be used to deliver fuel during conditions when high pressure direct injection is pulse-width or dynamic range limited. In addition, component reduction benefits are achieved. Overall, fueling errors are reduced, thereby improving engine performance.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for an engine, comprising:

during a first knock condition, operating a high pressure fuel pump to direct inject fuel at a variable pressure into an engine cylinder responsive to knock; and during a second knock condition including an engine operating condition being outside of one or more direct injection thresholds, operating the high pressure fuel pump to supply fuel via an inlet of the high pressure fuel pump to port inject fuel at a fixed pressure into the engine cylinder responsive to knock.

2. The method of claim 1, wherein, during the first condition, a knock-mitigating charge cooling requirement is higher and, during the second condition, the knock-mitigating charge cooling requirement is lower.

3. The method of claim 1, wherein, during the first condition, a fuel mass of the injection performed responsive to knock is lower than a direct injection threshold based on fuel mass delivery capabilities of the direct injection and, during the second condition, the fuel mass of the injection performed responsive to knock is higher than the direct injection threshold.

4. The method of claim 1, wherein the second condition is an engine speed exceeding an engine speed threshold.

5. The method of claim 4, wherein the engine speed threshold is determined based on limitations of a pulse width of the direct injection.

6. The method of claim 1, wherein the high pressure fuel pump direct injects the fuel by supplying fuel through a high pressure fuel pump outlet, and the high pressure fuel pump port injects the fuel by supplying fuel through a supply line upstream of a high pressure fuel pump inlet.

7. The method of claim 1, wherein the second condition is an engine load below an engine load threshold.

8. The method of claim 1, wherein, in the second condition, a direct injection pulse width exceeds a requested fuel amount.

9. The method of claim 1, wherein, in the first condition, a direct injection pulse width is greater than a first fuel mass threshold and less than a second fuel mass threshold.

10. The method of claim 1, further comprising reducing an amount of fuel direct injected in the second condition.

* * * * *